United States Patent [19]

Goto et al.

[11] Patent Number: 4,761,145

[45] Date of Patent: Aug. 2, 1988

[54] HOUSING FOR ELECTRICAL CONNECTORS

[75] Inventors: Kazuhiro Goto, Markham; Ross L. Mair, Barrye, both of Canada

[73] Assignee: AMP Incorporated, Harrisburg, Pa.

[21] Appl. No.: 34,139

[22] Filed: Apr. 2, 1987

[51] Int. Cl.[4] ..... H01R 13/595

[52] U.S. Cl. ..... 439/469; 439/906

[58] Field of Search ..... 439/462–469, 439/906

[56] References Cited

U.S. PATENT DOCUMENTS 3,904,265 9/1975 Hollyday et al. ..... 439/469

3,995,947 12/1976 Lightner et al. ..... 439/364

4,549,780 10/1985 Bertini et al. ..... 439/465

*Primary Examiner*—Neil Abrams

*Attorney, Agent, or Firm*—Allan B. Osborne

[57] ABSTRACT

A housing for an electrical connector having terminated wires extending away therefrom. More particularly, the housing is formed from shells with openings facing in different directions to provide alternate wire openings so that the wires can exit in one of several different angles and includes a screw activated clamp for clamping the wires as they exit from the housing. The housing further may be made from metallic material and thereby providing EMI and RFI shielding.

9 Claims, 5 Drawing Sheets

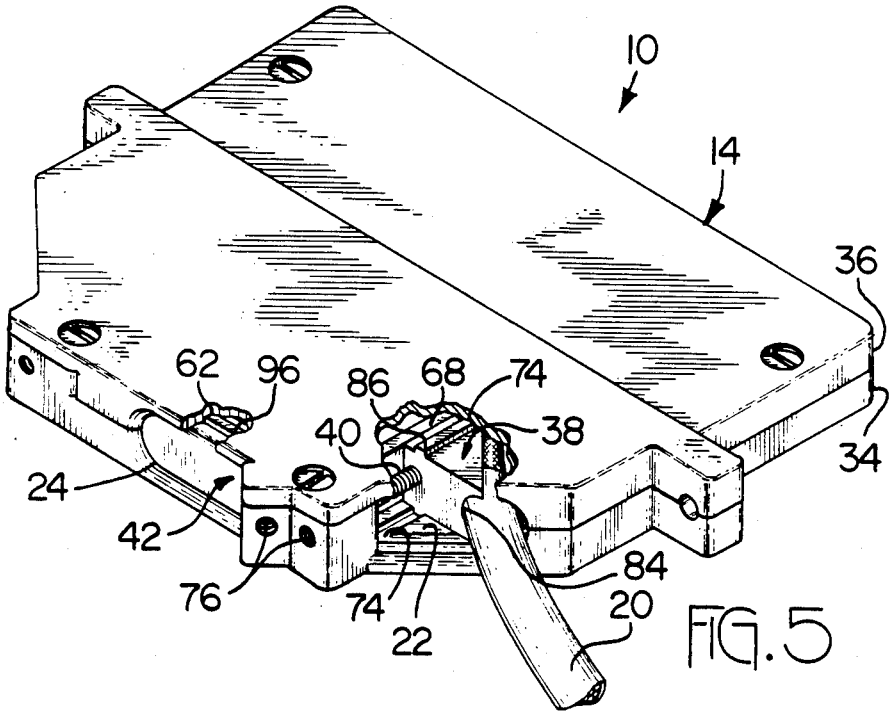
FIG. 5
FIG. 6
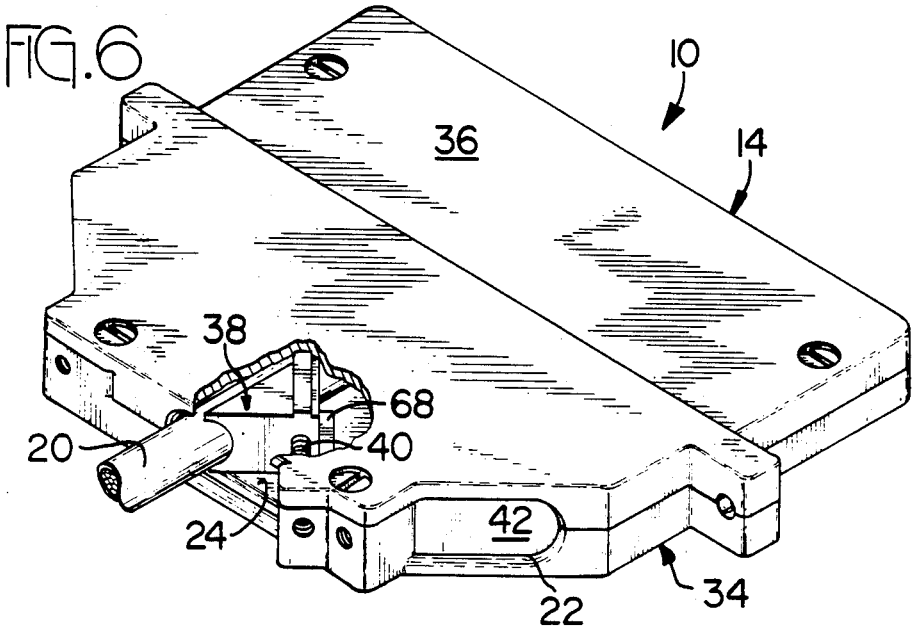

HOUSING FOR ELECTRICAL CONNECTORS

FIELD OF THE INVENTION

The invention relates to electrical connector housings which are adapted to accommodate cable entering through one or several alternative openings and which further provides EMI and RFI shielding.

BACKGROUND OF THE INVENTION

It is well known from the prior art to provide housings for enclosing electrical connectors to which a plurality of wires are terminated. Further, it is well known to provide an opening through which such wires, or a cable, pass with a stain relief member clamping them against one side of the selected opening. For example, U.S. Pat. No. 4,549,789 discloses a housing having a pair of spaced openings, located at an angle to each other, and as assembly which include a plug member and a cable clamp. The plug member, with an actuating screw positioned at an angle, is received in and blocks one opening, and the cable clamp, driven by the screw, is received in the other opening for clamping the wires or cable passing therethrough. The plug member and cable clamp are slidingly attached to each other by means of elongated arms on one being received in grooves on the other.

It is now proposed to provide an electrical connector housing having a simplified cable clamp with an actuating screw therefor mounted in the housing for securing the wires passing through an opening.

SUMMARY OF THE INVENTION

According to the present invention, a housing is provided for receiving an electrical connector and includes an opening at the rear through which wires terminated to the connector may pass. The housing is formed from a pair of shells having cooperating structures to form the opening and associated features. A clamp is provided along with first walls extending inwardly from one side of the opening and second walls extending inwardly from another side of the opening. The clamp is slidably positioned adjacent the second wall associated with a selected opening and driven towards the first wall by an actuating screw threadably mounted in a bore associated with the opening.

BRIEF DESCRIPTION OF THE DRAWINGS

FIGS. 5, 6 and 7 are perspective views showing a cable passing through different openings in the housing.

DESCRIPTION OF THE INVENTION

Figure 1:
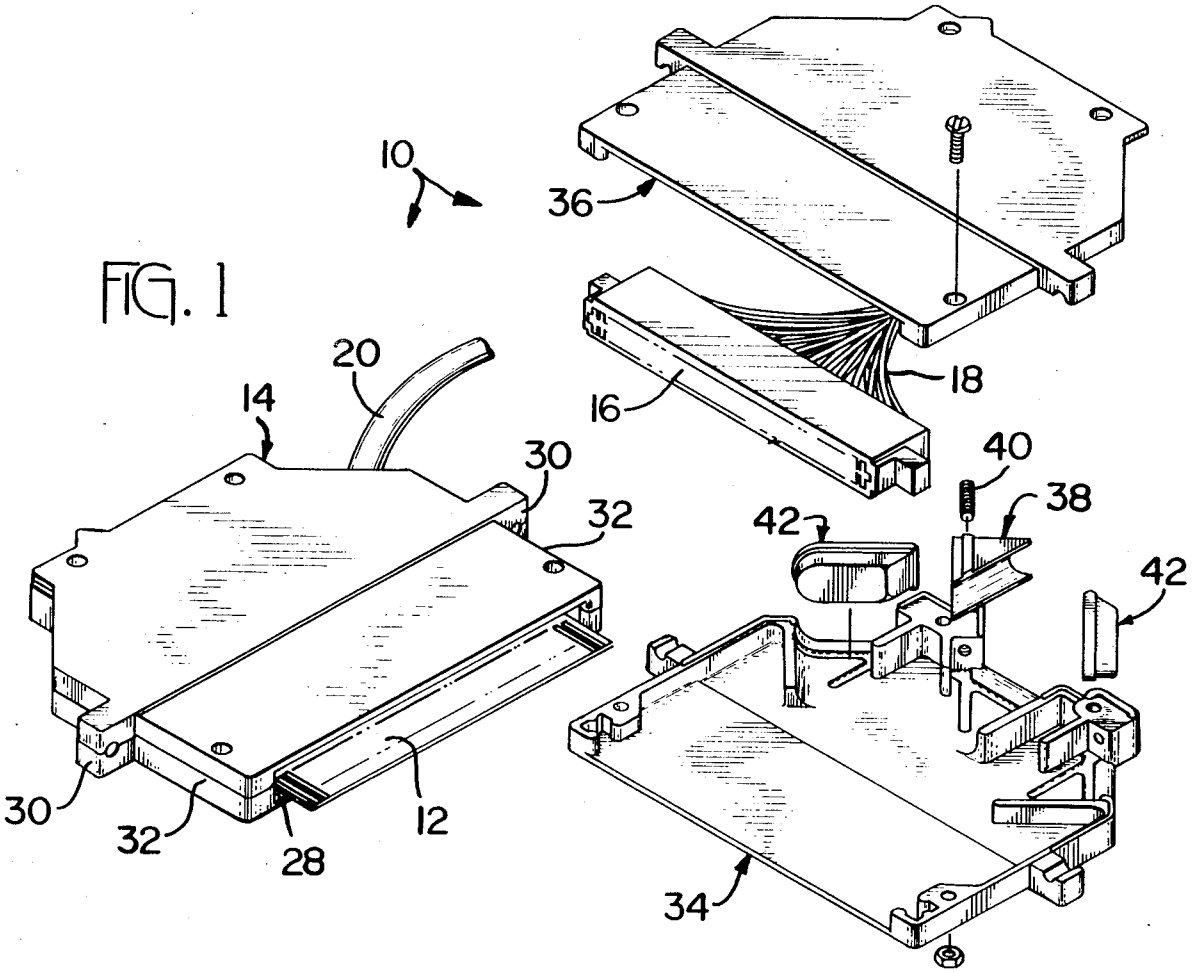
FIG. 1 is a perspective view of two connector assemblies with one assembly exploded to illustrate the housing of the present invention.

With reference to FIG. 1, two connector assemblies 10 are shown with the left hand assembly 10 being attached to an edge of circuit board 12 (only a segment being shown) and the right hand assembly 10 exploded to show in detail housing 14 of the present invention.

An assembly 10 includes connector 16, terminated to a plurality of individual wires 18 usually contained within a shielded cable 20 and housing 14 in which connector 16 is positioned and from which cable 20 exits. As better shown in FIG. 5, 6 and 7, three openings 22, 24 and 26 are provided in the rear portions of one embodiment of housing 14 through which cable 20 may pass.

In addition to one or more cable openings, an elongated slot 28 in the front face of housing 14 is provided for access to connector 16. Further, laterally projecting mounting lugs 30 are located on the two parallel sides 32.

The connector 16 shown is referred to as a twin leaf printed circuit edge connector by its manufacturer, AMP Incorporated, of Harrisburg, Pa. As will be discerned, however, housing 14 can accept other type connectors with minor or no modifications.

The components of housing 14 include shells 34, 36, clamp 38, its associated actuating screw 40, and two covers 42. Conventional fastening means such as bolts and nuts secure shells 34, 36 together.

Figure 2:
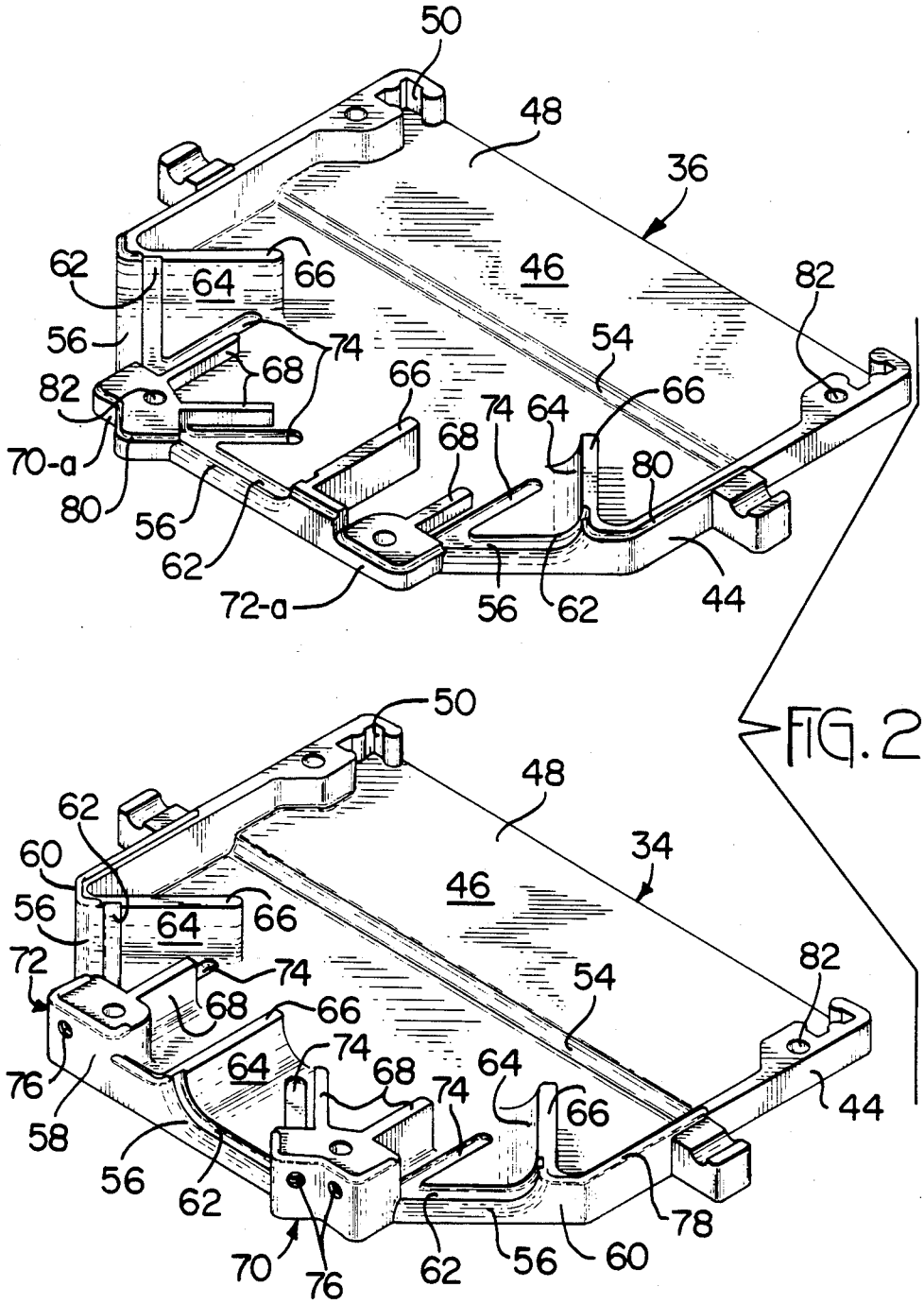
FIG. 2 is a perspective, exploded view of a connector assembly taken from another direction and with one half of the housing turned over.

FIG. 2 shows the inside of both shells 34, 36. As can be seen, the inside of shells 34, 36 are mirror images of each other except for two differences which will be expressly noted. Accordingly, features common to both will be indicated by the same reference numerals. Further, structures on both shells cooperate to form structures in housing 14; e.g., channels 56 on shells 34, 36 cooperate to form openings 22, 24 and 26 in housing 14.

Figure 4:
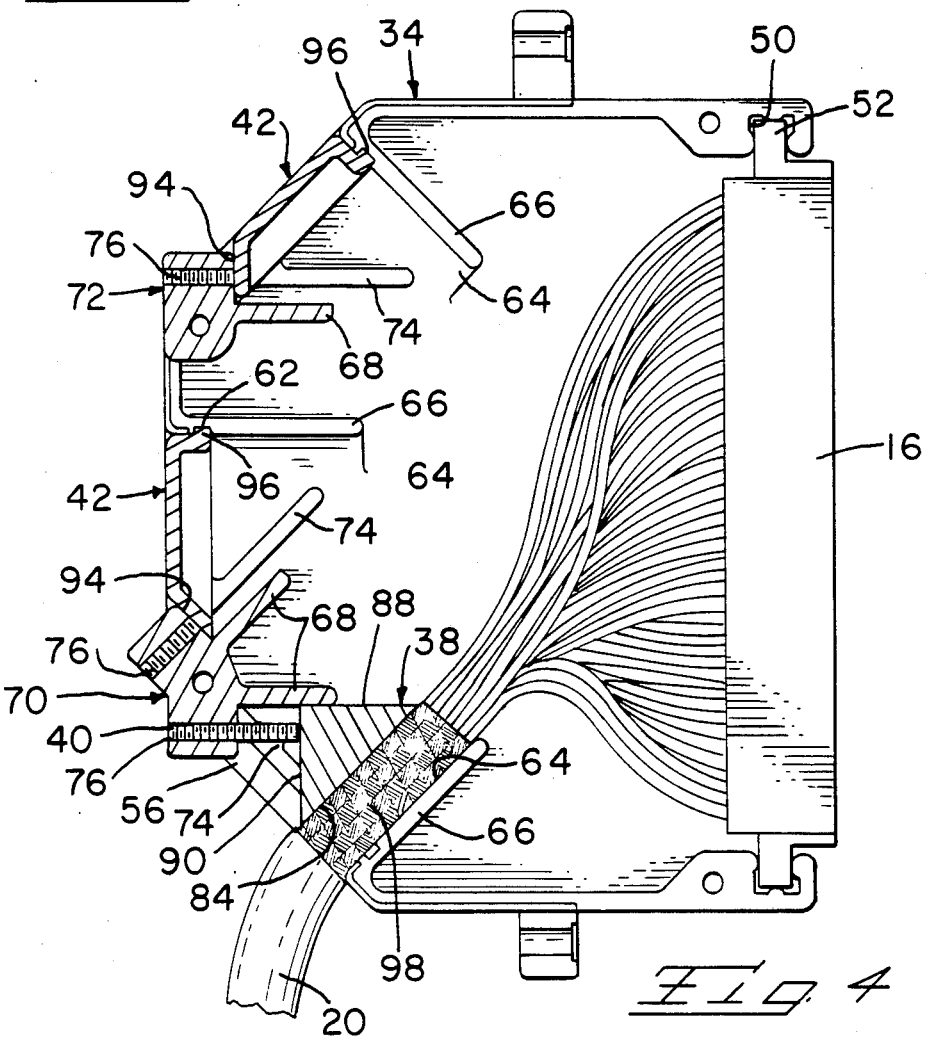
FIG. 4 is a plan view of a connector assembly with one half of the housing removed.

Upstanding wall 44 extends around the periphery of base wall 46 except for an elongated space 48 across the front face of shells 34, 36 which forms the aforementioned elongated opening 28 in housing 14. Notches 50 provided in wall 44 on each side of space 48 receive mounting ears 52 on connector 16 as shown in FIG. 4. The boundary between front and rear portions of each shell 34, 36 is indicated by step 54 in base wall 46.

Channels 56 cut through wall 44 at three spaced loactions around the rear portion of shells 34, 36; at rear face 58 and the two oblique faces 60 at each side thereof. Grooves 62, cut into base wall 46, extend across channels 56 and up the curved surface 64 of first upstanding walls 66. These three walls extend inwardly from wall 44 at one side of each channel 56 and define one side of wire receiving paths. A second upstanding wall 68 extends inwardly along an opposite side of each channel 56. These second walls 68, attached to upstanding blocks 70, 72, converge towards first walls 66. Grooves 74, cut into base wall 46, are adjacent to and parallel second walls 68.

Block 70 is provided with two threaded bores 76 which are parallel with base wall 46 and coaxial with respective grooves 74 adjacent thereto. Block 72 is provided with one threaded bore 76 which is also parallel with base wall 46 and coaxial with groove 74 adjacent that block.

A thin rib 78 is provided on top of perimeter wall 44 rearwardly of half portions of mounting lugs 30 and on blocks 70, 72. The counterpart on shell 36 is ledge 80, which receives rib 78 when shells 34, 36 are joined together to obtain a closed interface.

As can be seen in FIG. 2, the counterparts on shell 36 to blocks 70, 72 on shell 34 are blocks 70-*a* and 72-*a*. These blocks rise only slightly above base wall 46 and have no threaded bores. Ledge 80 and blocks 70-*a*, 72-*a*, constitute the differences between the shells referred to above.

The several holes 82, which are normal to base wall 46, are for the fasteners used to hold shells 34, 36 together; e.g., bolts and nuts.

Figure 3:
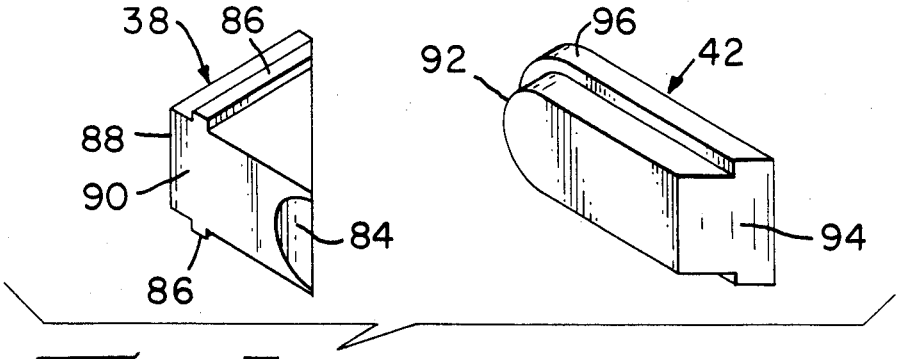
FIG. 3 is a perspective view of two components of the housing.

As shown in FIG. 3, clamp 38 is triangularly shaped with the hypotenuse side 84 being concave. Outwardly projecting rails 86 on opposing surfaces of clamp 38 are parallel to side 88 and normal to side 90.

Cover 42 is a generally rectangular block with end 92 being rounded and the opposite end having a beveled face 94. Rail 96 extends around the perimeter of cover 42 except for beveled face 94.

With reference to FIG. 4, the assembly of assembly 10 begins with placing connector 16 into shell with cable 20 passing through a selected channel 56. As shown, the insulation around braided jacket 98 of cable 20 has been removed. Clamp 38 is added such that cable 20 is between concave side 84 thereon and curved surface 64 of the first upstanding wall 66 associated with the channel 56 selected; i.e., when so positioned, clamp 35 defines the other side of the wire receiving path. Rail 86 on one side of clamp 38 is slidably received in the appropriate groove 74 and side 88 bears slidably against the appropriate second upstanding wall 68. Actuating screw 40 is threaded into the appropriate bore 76 and advanced, engaging clamp 38 on its side 90. Clamp 38 may be moved inwardly, guided by wall 68 and groove 74 towards first wall 66 to loosely clamp cable 20 against curved surface 64 thereof. Covers 42 are placed into the unused channels 56 with rails 96 being received in grooves 62 and beveled faces 94 conformably bearing against the inside surfaces of blocks 70, 72 to close off the unused bores 76.

Shell 36 is then placed onto and secured to shell 34, forming housing 14 as shown in FIG. 5. Rail 86 on clamp 38 is received in the appropriate groove 74 and rails 96 on covers 42 are received in appropriate grooves 62 in shell 36. After securing shells 34, 36 together, screw 40 is advanced further in to tightly compress cable 20 between the concave surface forward by cooperating curved surfaces 64 of the joined walls 66 of the two shells 34, 36 and concave side 84 of clamp 38. Cable 20 is accordingly protected from strain exerted thereagainst and braided jacket 98 is in electrical contact with housing 14 to establish a ground connection therebetween.

Shielding from electromagnetic and radio frequency waves is obtained by avoiding gaps between joined shells 34, 36 in the following ways. Covers 42 block off the two unused openings; e.g., openings 24 and 26. Rails 96, received in grooves 62 to hold covers 42 in place, also prevent direct or straight through access into the interior of housing 14. Similarly, rib 78 on shell 34 being received in ledge 80 on shell 36 avoids gaps which may otherwise occur where two flat faces are placed together. The particular opening used; e.g. opening 22, is also closed off by cable 20 filling the passage formed by concave side 84 of clamp 38 and cooperating curved surfaces 64 of first walls 66. Further, as can be seen in FIGS. 4 and 5, there is an overlap between clamp 38 and the adjacent second wall 68 to block off entrance to the housing 14 interior.

Figure 7:
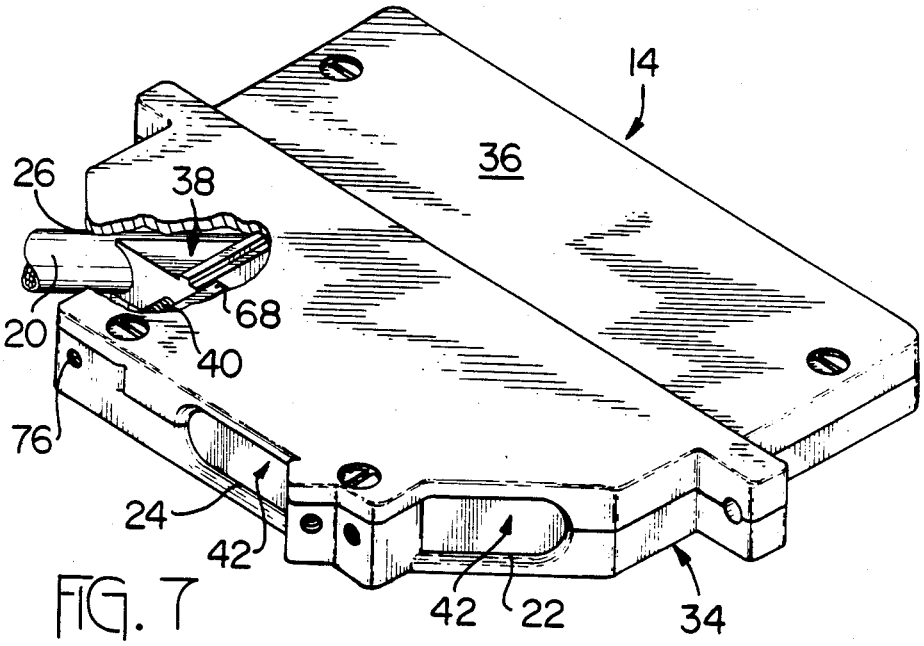

FIG. 5 shows cable 20 passing the opening 22. FIGS. 6 and 7 show assemblies 10 with cable 20 passing through openings 24 and 26 respectively. In each case, the same clamp 38, screw 40 and covers 42 are used.

Housing 14 is preferrably made from zinc with the manufacturing process being casting. However, housing 14 could be made from a plastics material with a metalized surface finish or, if shielding is not required, without such a finish.

Figure 8:
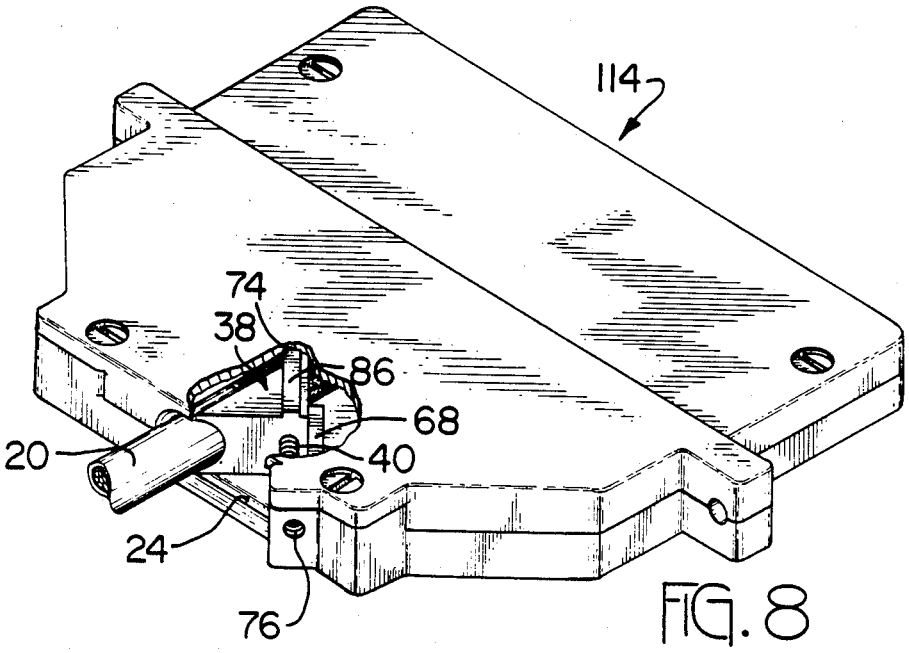
FIG. 8 shows another embodiment of the housing of the present invention.

FIG. 8 shows a second embodiment of the housing of the present invention. In this embodiment, the housing, indicated by reference numeral 114, is provided with a single opening in the rear portion; e.g., opening 24. Clamp 38 and the structure associated with opening 24 is as described above with reference to housing 14.

As can be discerned, a housing for housing an electrical connector and providing an opening through which a cable, terminated to the connector, may pass has been disclosed. the housing includes two shells having structural features that cooperate to form the openings and also to provide EMI and RFI shielding. Covers are provided to block off the unused openings, and a screw actuated cable clamp secures the cable to provide strain relief. The covers, clamp and actuating screw may be used in any of the three openings. Additionally, another embodiment has been disclosed in which a single opening has been provided.

We claim:

1. A housing for an electrical connector from which wires extend, said housing comprising:

a pair of mating shells, each having a floor with a perimeter wall extending at least along the side and rear edges of said floor and a channel through said wall at a rear face, said channels cooperating to provide when said shells are mated, an opening through which wires may pass, said shells further having:

block structures integral with said perimeter wall and located to one side of said channels with one of said structures having a threaded bore extending inwardly therethrough and with the axis thereof being at an acute angle relative to said channel;

a first wall attached to said perimeter wall on the side of said channel opposite said block structure and extending inwardly to define one side of a wire receiving path, said path being coaxial with said channel in said perimeter wall;

grooves in said floors with the longitudinal axis of each said groove converging with said wire receiving path at an angle of less than ninety degrees;

a second wall attached to said block structure and extending inwardly parallel to the axis of said threaded bore and to said groove in said floor;

a clamp having rails on two opposing sides thereof and positioned within said shells when mated for movement along said second wall with said rails being received in said grooves, said clamps defining another side of said wire receiving path; and a machine screw threadedly mounted in said threaded bore to engage said clamp and when rotated in said bore to move said clamp along said second wall towards said first wall to clamp wires therebetween which may be in said wire receiving path.

2. The housing of claim 1 wherein said first walls have a curved surface facing said second walls and said clamp includes a concave surface facing said first walls so that said curved surfaces and concave surface cooperate to conformably receive wires therebetween.

3. The housing of claim 1 wherein said second walls and said clamp are always in an overlapped relation.

4. The housing of claim 1 further including interfingering means on said perimeter walls for engaging each other to prevent gaps between said perimter walls when said shells are mated.

5. The housing of claim 1 further including additional channels, block structures, first and second walls, grooves and cover means for covering channels not having wires passing therethrough.

6. The housing of claim 1 wherein grooves are provided in the floor of the channels and said cover means include a rail which is received in said grooves.

7. The housing of claim 1 wherein said cover means are further adapted to cover said threaded bores in said block structures.

8. The housing of claim 1 wherein said shells and clamp are made from a metallic material to provide EMI and RFI shielding.

9. The housing of claim 1 wherein said shells, clamp and cover means are made from a metallic material to provide EMI and RFI shielding.

* * * * *